US006920963B2

(12) United States Patent
Faller

(10) Patent No.: US 6,920,963 B2
(45) Date of Patent: Jul. 26, 2005

(54) APPARATUS HAVING VERTICALLY MOVABLE PERSONNEL CAGES FOR A SPREADER

(75) Inventor: Heide Faller, Ergoldsbach (DE)

(73) Assignee: FM Patentverwertung KG, Essenbach/Altheim (DE)

( * ) Notice: Subject to any disclaimer, the term of this patent is extended or adjusted under 35 U.S.C. 154(b) by 201 days.

(21) Appl. No.: 10/363,378

(22) PCT Filed: Aug. 27, 2001

(86) PCT No.: PCT/EP01/09862

§ 371 (c)(1),
(2), (4) Date: Apr. 2, 2003

(87) PCT Pub. No.: WO02/18263

PCT Pub. Date: Mar. 7, 2002

(65) Prior Publication Data

US 2003/0168289 A1 Sep. 11, 2003

(30) Foreign Application Priority Data

Aug. 27, 2000 (DE) ..... 100 41 932

(51) Int. Cl.[7] ..... B66D 7/02

(52) U.S. Cl. ..... 187/406; 212/291; 212/312; 414/139.5

(58) Field of Search ..... 187/239, 241, 187/242, 406, 408, 900; 212/175–181, 291, 312, 324–327, 212, 316, 271; 414/10–12, 139.5, 140.3, 460, 471, 508, 561, 631, 641

(56) References Cited

U.S. PATENT DOCUMENTS

| | | | | | |
|---|---|---|---|---|---|
| 4,172,685 | A | * | 10/1979 | Nabeshima et al. | 414/139.7 |
| 4,266,904 | A | * | 5/1981 | Fadness | 414/460 |
| 4,546,852 | A | | 10/1985 | Martin et al. | 182/12 |
| 4,858,775 | A | * | 8/1989 | Crouch | 212/312 |
| 5,407,316 | A | * | 4/1995 | Coatta et al. | 414/787 |
| 5,515,982 | A | * | 5/1996 | Hasegawa et al. | 212/316 |
| 5,775,866 | A | * | 7/1998 | Tax et al. | 414/140.3 |
| 6,478,172 | B2 | * | 11/2002 | Zingerman | 212/179 |
| 6,802,684 | B2 | * | 10/2004 | Arntzen et al. | 414/140.3 |

FOREIGN PATENT DOCUMENTS

| | | | |
|---|---|---|---|
| WO | WO 99/64342 | 12/1999 | B66F/11/04 |

* cited by examiner

*Primary Examiner*—Jonathan Salata
(74) *Attorney, Agent, or Firm*—Cohen, Pontani, Lieberman & Pavane

(57) ABSTRACT

An apparatus for transporting people by a spreader having a vertically moveable head beam with a pair of horizontally extendable long bars includes a pair of personnel cages carried by a pair of cantilever beams extending from a housing. The personnel cages can be mounted to free ends of the long bars and be moved vertically with respect to the spreader.

10 Claims, 5 Drawing Sheets

Fig. 1
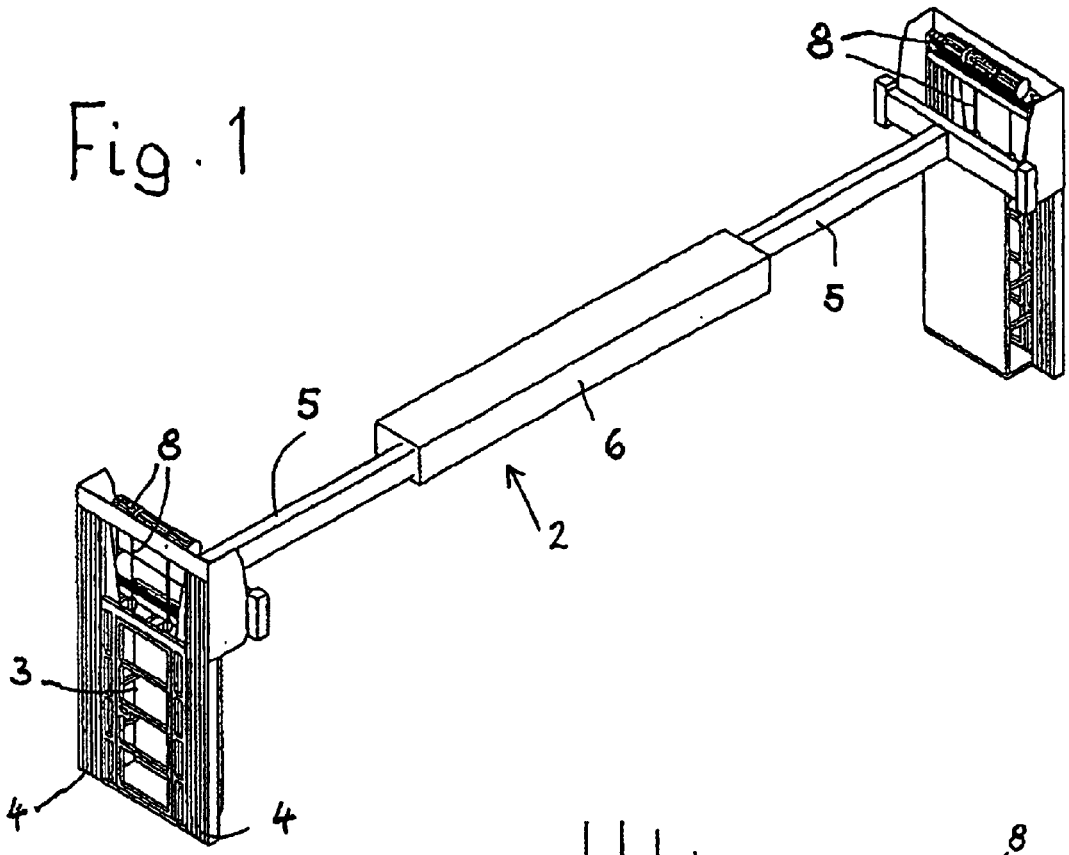
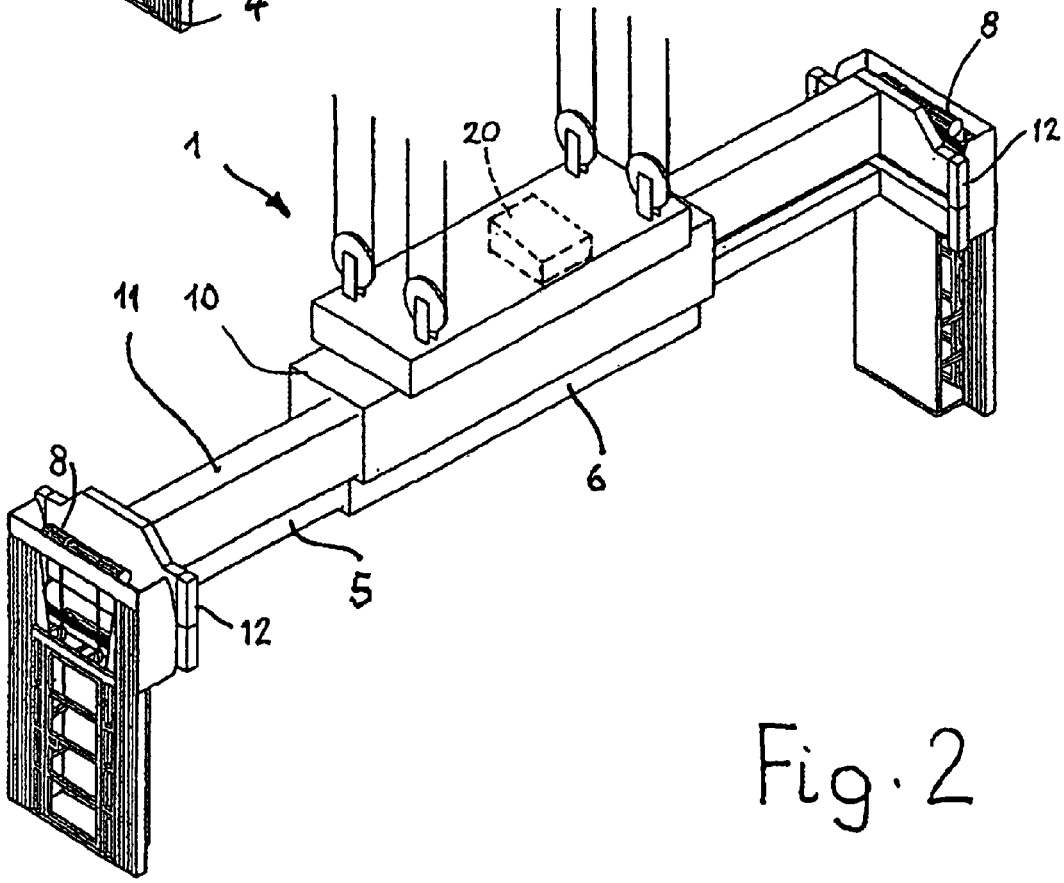
Fig. 2

APPARATUS HAVING VERTICALLY MOVABLE PERSONNEL CAGES FOR A SPREADER

PRIORITY CLAIM

This is a U.S. national stage of application No. PCT/EP01/09862, filed on 27 Aug. 2001. Priority is claimed on that application and on the following application: Country: Germany, Application No.: 100 41 932.1, Filed: 27 Aug. 2000.

BACKGROUND OF THE INVENTION

1. Field of the Invention

The invention relates to a device for transporting people by a spreader having a vertically movable head beam with horizontally extendable long bars.

2. Description of the Related Art

When unloading containers transported on ships, at first the containers have to be unshipped which are positioned on the hatch covers. In order to protect them against falling off during the journey the containers are locked against each other and relative to the hatch covers by means of so-called "twistlocks" (interlocking elements to be provided at the corners of the containers). Prior to the unloading procedure, said twistlocks have to be unlocked manually. In the case of twistlocks which must be handled completely manually, they are put first, also for the loading procedure, on the hatch cover or on the containers already loaded, whereupon they are also manually interlocked. As the containers are often stacked up to five layers on the hatch covers, it is extremely difficult to reach them from the deck or from the gangways between the container stacks. The lower two layers are locked or unlocked by rods from the deck or the gangway, whereas the upper layers have to be unlocked from above, using the afore mentioned rods. As in many cases salient containers hinder accessibility, the before mentioned operations are extremely dangerous and often result in fatal accidents. This is why in many States legal provisions have been issued generally prohibiting any operation from the upper surface of the containers. However, said provisions cannot be followed in practice because, up to now, suitable devices are missing which could safely transport the staff on the spot to open the twistlocks.

In view of these problems various producers are trying to find a solution and offer appropriate devices. Said devices (so-called personnel cages) are used to transport the staff as near as possible to their point of intervention. Personal cages are known which—when hanging under the spreader—are positioned on the uppermost container. From here, the staff operates using the already mentioned rods. In a further known device, two cages occupied by operators and also hanging underneath the spreader, hang down along the front parts of the containers, such that they make it possible to safely reach at least the twistlocks of the uppermost layer. A further known device facilitates, by means of three personnel cages interconnected through ladders, the locking and unlocking of the three uppermost layers. However, this device, due to its overall height, is only fit for limited use (necessary hoisting height and salient containers). A further important requirement to facilitate an efficient routine of loading and unloading is the necessity to mount said device directly on the bridge crane use for ship loading. Due to the specific construction of these very expensive bulk devices there is no place suitable for such a device.

SUMMARY OF THE INVENTION

It is an object of the invention to provide a device which may be simply picked up by the spreader, which has overall dimensions facilitating the mounting on the bridge crane and from which it would be possible to lock and unlock at least two to four layers of containers.

This problem is resolved by at least one personnel cage which can be mounted on the free end of a respective at least one of the long bars, each personnel cage being vertically moveable with respect to the respective long bar.

BRIEF DESCRIPTION OF THE DRAWINGS

FIG. 1 is a perspective view of the device, as a whole called "personnel cage", FIG. 2 is a perspective view of the personnel cage picked up from the spreader.

DETAILED DESCRIPTION OF THE PRESENTLY PREFERRED EMBODIMENTS

Figure 3:
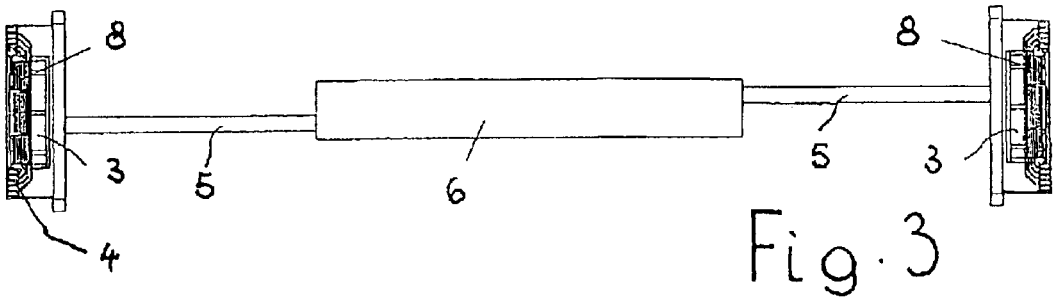
FIG. 3 is a top view of the entire personnel cage.
Figure 4:
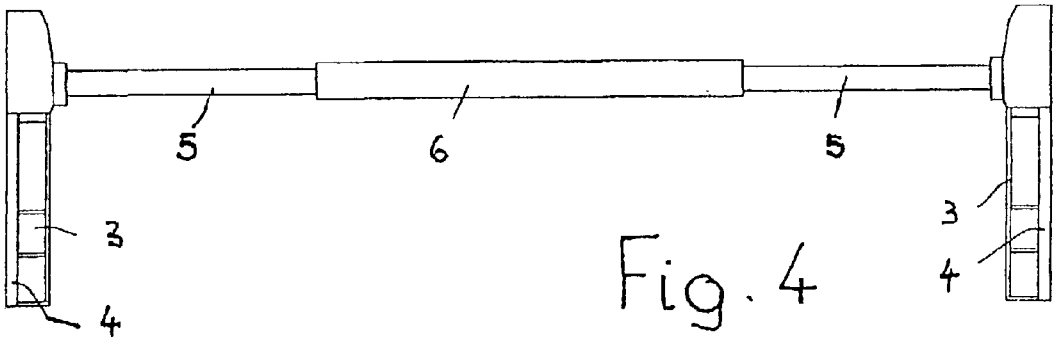
FIG. 4 is a front view of the personnel cage.
Figure 5:
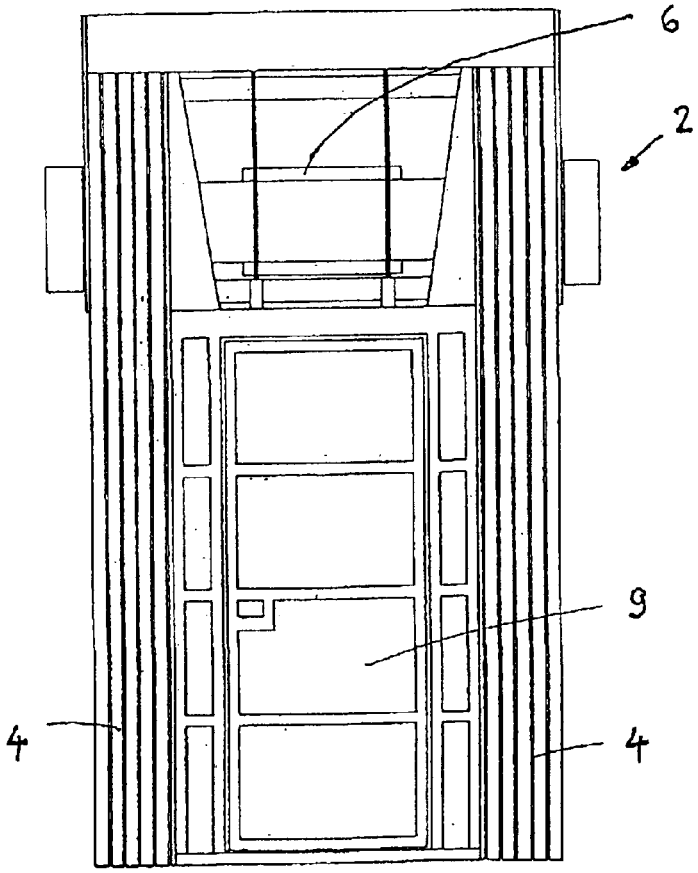
FIG. 5 is a lateral view of the personnel cage.
Figure 6:
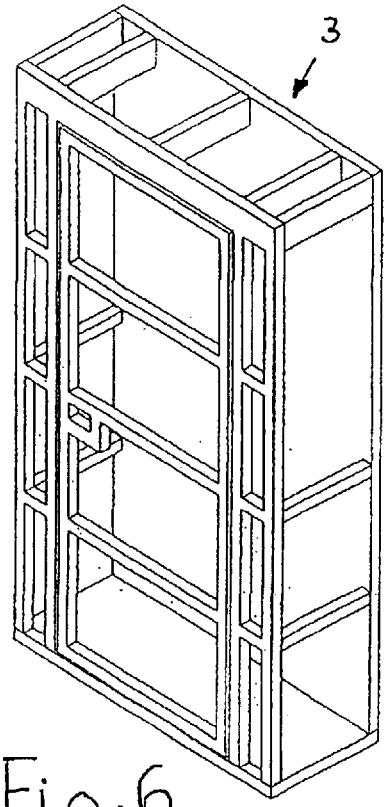
FIG. 6 is a perspective view of the personnel cage from the side of the door.
Figure 7:
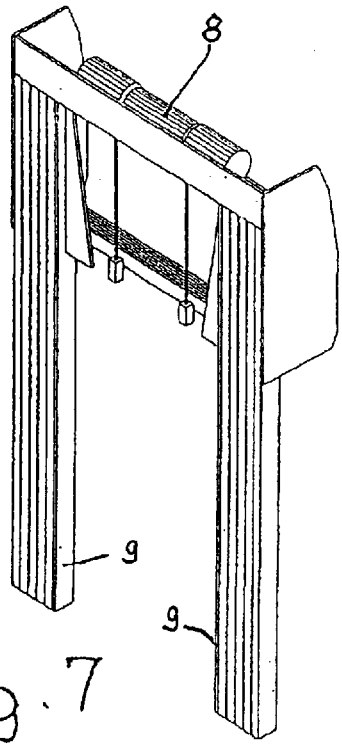
FIG. 7 is a perspective view of the telescopic bars of the personnel cage.
Figure 8:
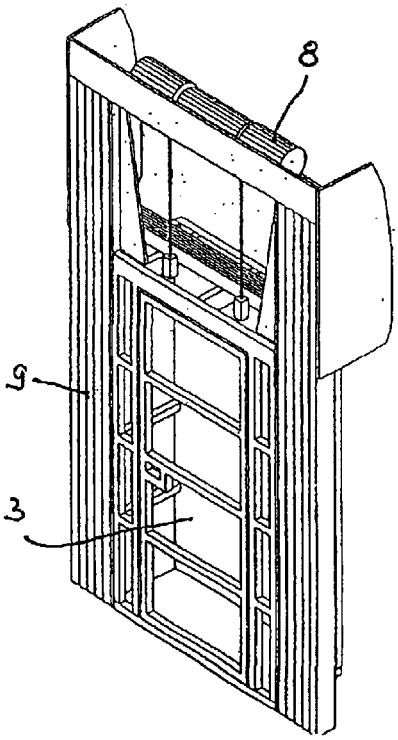
FIG. 8 is a perspective view of the personnel cage with its bars from the side of the door.
Figure 9:
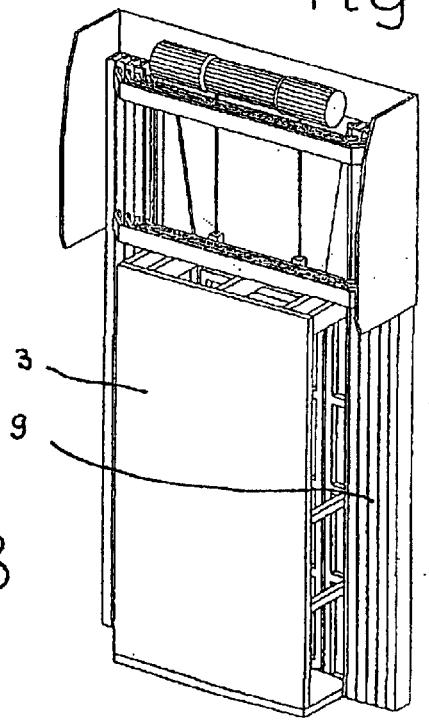
FIG. 9 is a perspective view of the personnel cage with its bars from the side facing the container.
Figure 10:
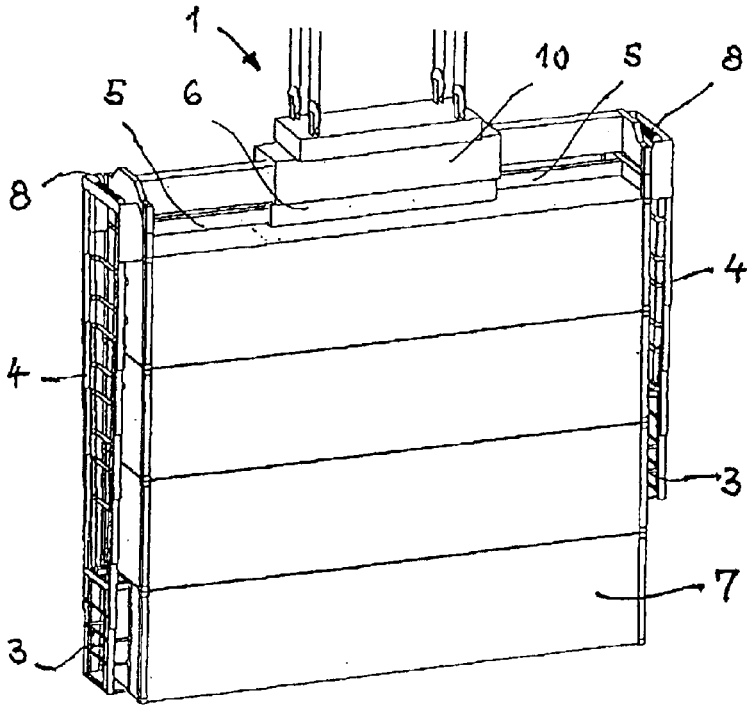
FIG. 10 is a perspective view of the entire personnel cage picked up from the spreader positioned on a stack of containers, being in a vertically telescopic extended working position.
Figure 11:
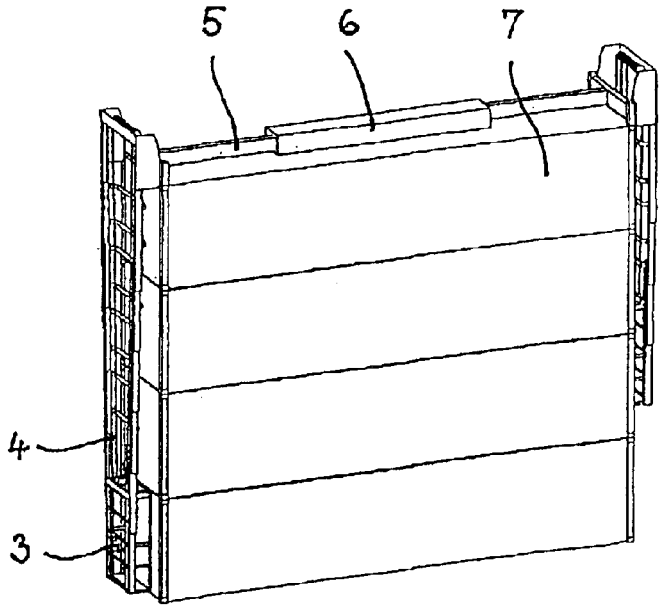
FIG. 11 is a perspective view of the entire personnel cage without spreader, in its position on the top of a container stack and in a vertically telescopic extended working position.
Figure 12:
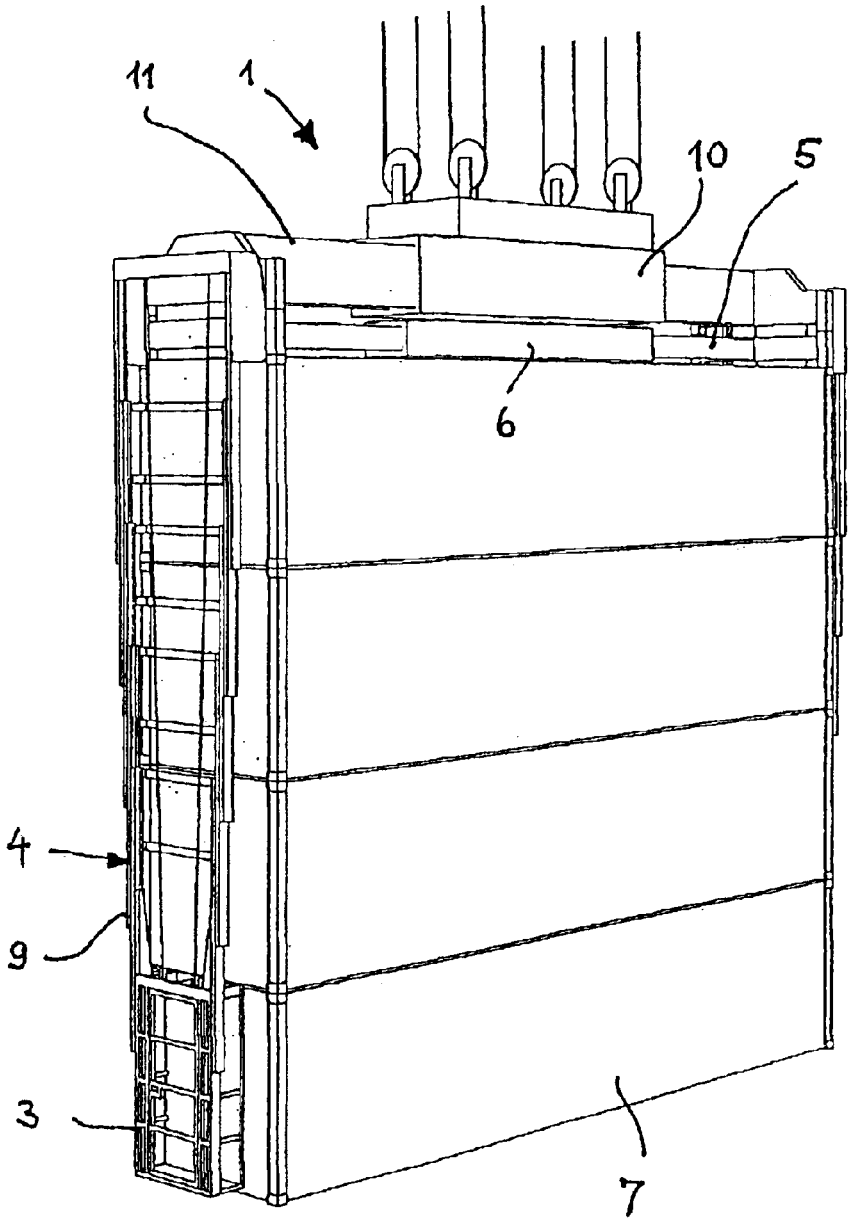
FIG. 12 is a view similar to that of FIG. 10.

As illustrated in the drawing it is provided that a spreader 1 is suited to pick up a carrier 2 to which are fastened, at both ends, two personnel cages 3 used to carry operators. Each of said personnel cages 3 may be extended downward by means of a vertical telescoping frame 4 to such a position that all layers of containers 7 may be easily reached. The personnel cage 3 offers to the transported operators sufficient protection not only during the entering phase between the container stacks but also during vertical movement.

The entire device comprises an upper carrier 2 which is preferably constructed as a coupling that may be automatically picked up by the spreader 1 without the need of any modification. Obviously, other embodiments may also be used allowing the fixing of the carrier 2 to the head beam 10 of the spreader 1 manually by means of a separate pick up device or also automatically.

As shown in figure 1, personnel cages 3 are fastened to respective cantilever beams 5 telescopically mounted in a housing 6. The spreader 1 has a vertically moveable head beam 10 with a pair of horizontally extendable long bars 11 provided with couplings 12 for coupling to the cantilever beams 5. The horizontal propulsion for extending and retracting the cantilever beams 5 is effected by the corresponding movement of the long bars 11 of spreader 1. In this way it is possible that, in the case of shifting above long containers, it is not necessary to transport the entire personnel cage over the top of the containers, but it is sufficient to move it in the same vertical position without any need to lift it, simply relocating it relative to the front faces in a transverse direction. This has the advantage that in the case of several long containers 7, positioned one adjacent to the other, the twistlocks can also be opened or locked which are positioned at the bottom.

On both cantilever beams 5 vertically telescoping frames 4 are fastened enabling the personnel cage 3 to be lowered to such an extent that all necessary operational positions may safely be reached without the need to use rods or the like. The bars 9 of the telescoping frames 4 may be nestled one inside the next as often as necessary to obtain the smallest possible overall width when in the retracted position. Said bars 9 are positioned outside the frontal boundary of the containers 7, but inside the maximum width of containers.

The "real" personnel cage 3 with all of the control elements is fastened at the bar 9 which can be telescopically extended to the lowest position. The cage is constructed in such a way that it guarantees the maximum protection for the staff and the optimum of accessibility to the twistlocks. The closed wall may contain the control elements; at the same time it has the function of a sliding surface along the containers 7.

According to the illustrated embodiment each of the personnel cages 3 is provided with its own lifting motor 8 to be operated from the side of the corresponding personnel cage 3. Said lifting motor 8 may be a motor with ropes or a hydraulic motor.

The energy necessary for lifting and lowering the personnel cages 3 is preferably provided as electrical power supplied by means of a power supply 20 in the spreader 1. On the other hand, it would be possible to provide it in the form of hydraulic power or to accumulate the static and the kinetic energy available when positioning the spreader 1. The accumulation (e.g. storage battery or hydraulic accumulator) of the energy induced into the device has the advantage that the device may be put on a container stack. This enables the staff to operate one alter the other in all positions of a stack, independent of the presence of the spreader 1, which in the meantime is free to carry out other loading or unloading operations. In the case of a power supply via the spreader I it is advantageous if the connection to the spreader 1 is automatically re-established when it is positioned again. Alternatively, a manual coupling is also possible.

The energy supply for lifting the personnel cage 3 again may be realized as follows:

1. External Energy Supply 1.1. Electric, hydraulic, pneumatic power supply from the spreader 1 to the personnel cage 3 via manual contacting (contact plugs).

1.2. Electric, hydraulic, pneumatic power supply from the spreader 1 to the personnel cage 3 via automatic contacting (plugs) when coupling spreader–personnel cage.

2. Energy Accumulation 2.1. During positioning the spreader 1 on the personnel cage 3, the energy present in the form of weight of spreader× lowering height is stored by means of:

2.1.1. hydraulic cylinders which are compressed by the weight of the spreader, in hydraulic storage medium, 2.1.2. mechanical spring accumulator compressed by the weight of the spreader, 2.1.3. counterweight which is lifted by the weight of the spreader via deflection pulleys for ropes or chains or the like, in such a way as to store energy.

2.2. During repositioning the personnel cage 3 by means of the spreader 1 into the inoperative position the energy present in the form of weight of (spreader+personnel cage)× lowering height by means of:

2.2.1. hydraulic cylinders which are compressed by the weight of the spreader, in hydraulic storage medium, 2.2.2. mechanic spring accumulator compressed by the weight of the spreader, 2.2.3. counterweight which is lifted by the weight of the spreader via deflection pulleys for ropes or chains or the like, in such a way as to store energy.

What is claimed is:

1. Apparatus for transporting people by a spreader having a vertically moveable head beam with a pair of horizontally extendable long bars, each said long bar having a free end, said apparatus comprising at least one personnel cage, each said personnel cage being mountable to a respective said free end; and means for moving each said personnel cage vertically with respect to said spreader.

2. Apparatus as in claim 1 comprising a pair of said personnel cages.

3. Apparatus as in claim 2 further comprising a housing connected between said personnel cages, said housing being coupleable to said head beam.

4. Apparatus as in claim 3 further comprising a pair of cantilever beams mounted in said housing, each said cantilever beam carrying a respective said personnel cage.

5. Apparatus as in claim 4 wherein said cantilever beams are horizontally extendable from said housing, said cantilever beams being coupleable to respective said long bars so that each said cantilever beam can be moved horizontally with the respective said long bar.

6. Apparatus as in claim 4 wherein said means for moving each said personnel cage vertically comprises a plurality of telescoping frames connected between each said personnel cage and a respective said vertical beam.

7. Apparatus as in claim 1 wherein said means for moving each said personnel cage comprises a lifting motor for each said personnel cage.

8. Apparatus as in claim 7 further comprising means in each said personnel cage for operating the respective lifting motor.

9. Apparatus as in claim 1 further comprising a power supply for moving each said personnel cage vertically, said power supply also supplying power for said spreader.

10. Apparatus as in claim 7 wherein said spreader provides static and kinetic energy which can be used to power the lifting motor of each said personnel cage.

* * * * *